US012203485B1

(12) United States Patent
Cerrona

(10) Patent No.: US 12,203,485 B1
(45) Date of Patent: Jan. 21, 2025

(54) DIESEL EXHAUST FLUID PUMP SYSTEM AND METHOD

(71) Applicant: Paragon Products, LLC, El Dorado Hills, CA (US)

(72) Inventor: Jonathan Cerrona, El Dorado Hills, CA (US)

(73) Assignee: Paragon Products, LLC, El Dorado Hills, CA (US)

( * ) Notice: Subject to any disclaimer, the term of this patent is extended or adjusted under 35 U.S.C. 154(b) by 83 days.

(21) Appl. No.: 17/902,309

(22) Filed: Sep. 2, 2022

(51) Int. Cl.

| | |
|---|---|
| ***F04C 15/00*** | (2006.01) |
| ***F01N 11/00*** | (2006.01) |
| ***F04C 2/18*** | (2006.01) |
| ***F04D 29/58*** | (2006.01) |

(52) U.S. Cl.
CPC ..... *F04D 29/5813* (2013.01); *F01N 11/00* (2013.01); *F04C 2/18* (2013.01); *F04C 15/0096* (2013.01); *F01N 2550/05* (2013.01); *F01N 2610/02* (2013.01); *F01N 2610/144* (2013.01); *F01N 2900/1808* (2013.01); *F01N 2900/1822* (2013.01); *F04C 2270/195* (2013.01)

(58) Field of Classification Search
CPC .. F04C 2/18; F04C 2/102; F04C 2/084; F04C 15/0096; F04C 15/0088; F04C 15/0038; F04C 15/008; F04C 2240/403; F04C 2270/195; F04B 39/064; F04D 29/5813; F04D 29/5806
See application file for complete search history.

(56) References Cited

U.S. PATENT DOCUMENTS

| | | | | |
|---|---|---|---|---|
| 5,605,448 | A * | 2/1997 | Martin, Sr. | F02M 37/08 417/360 |
| 11,101,765 | B1 | 8/2021 | Lehman et al. | |
| 2006/0140793 | A1* | 6/2006 | Krebs | F04C 2/086 417/420 |
| 2018/0254685 | A1* | 9/2018 | Seki | F04C 13/001 |

FOREIGN PATENT DOCUMENTS

| | | | | |
|---|---|---|---|---|
| DE | 102019131586 | A1 * | 5/2020 | F04B 35/04 |
| EP | 2378122 | A2 * | 10/2011 | F01C 21/007 |
| JP | 2009074517 | A * | 4/2009 | F04B 35/04 |
| WO | WO-9747884 | A2 * | 12/1997 | F04B 23/10 |
| WO | WO-2013003703 | A2 * | 1/2013 | F01N 3/2066 |
| WO | WO-2013105996 | A1 * | 7/2013 | F01C 19/005 |
| WO | WO-2018104719 | A1 * | 6/2018 | F04B 37/14 |
| WO | WO-2020141393 | A1 * | 7/2020 | F01C 21/10 |

* cited by examiner

*Primary Examiner* — Wesley G Harris
(74) *Attorney, Agent, or Firm* — Weintraub Tobin; Audrey A. Millemann

(57) ABSTRACT

The present invention relates to a diesel exhaust fluid (DEF) pump, DEF pump system and method for use of a DEF pump in cleaning the exhaust from diesel and diesel-electric engines. The DEF pump includes a plurality of gears, a pump housing, wear plate, pump body cover, a pump body insert, inverter assembly, inverter housing, speed sensor, pressure sensor, controller area network (CAN) connector, inverter cooling pipe, mounting feet or base plate, inlet, outlet, lifting ring, power connector, and motor. The DEF pump system includes a DEF pump, a main DEF tank, a dosing tank, a selective catalytic reduction (SCR) system, a flow control valve, and a relief valve. The DEF pump pulls DEF from a large tank, pumps DEF to a smaller tank injects DEF from the small tank into the exhaust stream where some of the DEF is consumed, and circulates unused DEF back to the large tank.

11 Claims, 17 Drawing Sheets

DIESEL EXHAUST FLUID PUMP SYSTEM AND METHOD

FIELD OF THE INVENTION

This invention relates generally to a fluid pump and method for using same, and more specifically it relates to a self-priming diesel exhaust fluid (DEF) gear pump and associated method for cleaning diesel engine emissions.

BACKGROUND OF THE INVENTION

In order to meet increasing government regulations on transportation and equipment emissions, vehicle and engine builders and their suppliers are forced to develop new technology that will improve emissions in vehicles, such as locomotives, excavators, haul trucks, and other vehicles using diesel engines, as well as in other stationary applications. For example, in the case of diesel and diesel-electric engines, such as without limitation those used in vehicles such as locomotives, industrial applications, and stationary power generation applications, there are currently several solutions to clean the exhaust coming from the engine. One of these solutions utilizes a selective catalytic reduction (SCR) system to filter toxic and environmentally damaging particles from the exhaust, chemically convert these particles into safer elements, and use the exhaust heat produced by the engine to continuously clean the catalytic filters. Such a system requires the use of diesel exhaust fluid (DEF) which is a solution of deionized water and urea. DEF can be stored in a large tank, such as on a vehicle like a locomotive, pumped to a smaller, low-pressure tank, and then injected into the exhaust stream. Some DEF is consumed in this process. Unused DEF is recirculated back to the large tank.

One of the drawbacks of a conventional DEF pump is that DEF will corrode most metals that are typically used for bearing surfaces or heat-exchangers. Furthermore, if the internal components of the pump are allowed to dry out after being wetted with DEF, the urea in the DEF will crystallize between bearing surfaces, greatly increasing the torque required to spin the gears in the pump's motor. In many instances, the pump will not be able to prime itself when the DEF has crystallized between bearing surfaces, because the pump will not be strong enough to break the pump free of these DEF crystals. This condition can happen every time a diesel engine, such as a diesel engine in a locomotive, is shut down because the entire DEF supply system is often purged with compressed air when the diesel engine is shut down.

In prior designs, the gears were pressed onto shafts that were captured in the pump body requiring significant disassembly to free the gears.

In addition, running a DEF pump while it is dry or when it has insufficient DEF can destroy it. Therefore, it is desirable for a DEF pump to be able to determine if it has been running dry or with insufficient fluid for an excessive amount of time and then shut itself down to prevent damage to the pump.

In addition, it is desirable for the DEF pump to be able to communicate with the engine to change its mode of operation and to receive and report diagnostics.

Further, it is desirable for the DEF pump to meet all performance and vehicle life cycle requirements, while at the same time limiting electromagnetic interference (EMI).

In addition, the DEF pump should be relatively easy to manufacture and not require extensive part-to-part alignment procedures such as shimming.

For the foregoing reasons, there is a need to overcome one or more of these shortcomings while also incorporating one or more of these desirable features.

BRIEF SUMMARY OF THE INVENTION

The present invention relates to a DEF pump and method for use of a DEF pump in cleaning the exhaust from diesel and diesel-electric engines. According to various embodiments, the DEF pump pulls DEF from a large tank, or reservoir, (e.g., a main DEF tank), pumps DEF to a smaller tank, or reservoir, such as a dosing tank, pressurizes the inlet of the smaller tank, injects DEF from the small tank into the exhaust stream where some of the DEF is consumed, and circulates unused DEF back to the large tank.

In one or more embodiments, the DEF pump is an external gear DEF pump, which uses two spur gears with a contact pitch line between the centers of rotation.

In one or more embodiments, the DEF pump is located above the large tank and can provide a flow of DEF at a specified pressure as required for a particular application.

In one or more embodiments, the pump body insert is comprises 316 stainless steel, the drive shaft bushing comprises 30 percent (30%) carbon-filled PEEK (polyetheretherketone) plastic, the gears comprise 30 percent carbon-filled PEEK plastic, the pump body cover wear plate comprises work-hardened 316 stainless steel sheet, the shaft seal housing comprises standard PEEK plastic, the drive shaft comprises 316 stainless steel, the pump body cover is made from 316 stainless steel, the shaft seal comprises 304 stainless steel, fluoroelastomer, and silicon carbide and/or ceramic, the inverter cooling pipe comprises 316 stainless steel, and the O-rings comprise EPDM (Ethylene Propylene Diene Monomer), which is a synthetic rubber, or a fluoroelastomer.

The present invention allows for purging of the DEF supply system to avoid urea crystallization after shut-down and storage. DEF can be purged by running the DEF pump in reverse for a finite amount of time. While the DEF pump is run in reverse for purging, high pressure, compressed air can be run through the system.

In one or more embodiments, the DEF pump is self-priming so that it can start when it is dry or has less than a minimum amount of DEF fluid. In one embodiment, the DEF pump is capable of self-priming even if it is located up to 5 feet above the fluid surface at standard atmospheric pressure and even if its internal components are completely dry and/or the fluid level in main DEF tank 120 is at a minimum level. Further, in most cases, the DEF pump provides sufficient torque to spin the gears after surfaces exposed to DEF dry out and freeze up due to crystallization. For typical levels of urea crystallization inside the DEF pump, the motor is strong enough to break the gears free and allow the pump to prime itself. In one or more embodiments, the motor design characteristics are chosen so that a flow rate of 2 GPM is provided with pressure of 10 psi at the outlet of the DEF pump.

In one or more embodiments, the DEF pump includes a pressure sensor integrated into the outlet side of the pump to allow the pump controller to determine if the pump has been running while dry for an excessive amount of time, and if so shuts the pump down to prevent damage to the pump. The presence of the sensor also allows the pump to run in a closed-loop pressure control mode of operation. The DEF pump can vary its speed to maintain a target pressure at its outlet. This target pressure can be stored in memory and used by the microcontroller that controls the DEF pump.

In one or more embodiments, the DEF pump is capable of communicating with the engine to change its mode of operation and to receive and report diagnostics. In one or more embodiments, the pump communicates with the engine control module (ECM) via the Controller Area Network (CAN bus). The ECM can provide control signals via the CAN bus to change the mode of operation of DEF pump 110. Also, the pump has the capability to change operation mode based on its own diagnostics. For example, if the pump detects that a pressure sensor input has been disconnected, the pump can change the mode of operation. Examples of modes of operation include standby, high-speed priming, running, reverse/purge, closed-loop pressure control, or open-loop speed control. The pump also has the capability to receive and report diagnostics using a bus or communication protocol, such as the CAN bus, to communicate with the ECM.

From an electrical standpoint, the DEF pump is capable of meeting all performance and life cycle requirements, while at the same time limiting electromagnetic interference (EMI). In one or more embodiments, the inverter housing and cover can comprise aluminum and the aluminum may be anodized. In addition, in one or more embodiments, portions of these parts can be masked before anodization or machined after anodization so that their various part-to-part interfaces provide good electrical conduction and minimize EMI leakage. The motor phase wires can be enclosed, such as within a flexible metal conduit or a sheet metal cover, that protects the wires and minimizes EMI radiation.

The disclosed DEF pump is relatively easy to manufacture and does not require extensive shimming for proper part-to-part alignment. By designing the parts of the DEF pump to be self-aligning, shimming is not required and no special measurements are required for aligning the parts during manufacture. To eliminate alignment issues, an assembly can be used where the drive shaft extends all the way into the pump body, and the drive gear slides onto the shaft, and the shaft applies torque via a shaft key as opposed to a press-fit interface. The pump body mounts directly to a front motor face.

In one or more embodiments, the DEF pump is designed to be able to survive sub-zero Fahrenheit (F) ambient temperatures and ambient temperatures above 150 degrees F. for continuous operation.

In one or more embodiments, the combination of the type-H motor stator windings, inverter cooling loop that flows DEF next to the power electronics, and materials allow the pump to be able survive high ambient temperatures, such as temperatures up to 300 degrees F., for short durations, such as up to 30 minutes.

In one or more embodiments, the DEF pump can endure a high vibration environment, such as that associated with locomotive and other industrial vehicle chassis mounted applications. Screw lengths, screw strengths, number of screws, location of screws, and size of screws are selected to withstand vibrations and shocks such as those associated with locomotive and other industrial vehicle chassis mounted applications. Materials and material finishes chosen are selected to withstand vibration and shock conditions such as those associated with locomotive and other industrial vehicle chassis mounted applications. A heavy-duty motor chassis with integrated mounting withstands vibration better than prior art implementations that used a lighter-duty motor with sheet metal mounting feet. In one or more embodiments, all electrical connections are minimum IP67 rated.

In one or more embodiments, the DEF pump can endure exposure to rain and snow, exposure to high-pressure and high-temperature engine washing fluid, and exposure to dust and iron particles. In one or more embodiments, the pump can withstand a pressure wash with 120 degree Fahrenheit tap water at 2000 psi at a distance of 12 inches away for 30 seconds. In one or more embodiments, there are drain ports put into strategic locations in case moisture does makes its way into locations that are sensitive to moisture. Further, in one or more embodiments, the drain ports have a labyrinth design so that high-pressure washing cannot reach sensitive components.

For example, in one embodiment, a diesel exhaust fluid pump comprises a motor comprising a plurality of Type-H stator windings; and a rotor; a drive shaft; a drive shaft bushing; a pump body cover; a pump body housing; a pump body insert; a plurality of gears; an inlet for receiving a diesel exhaust fluid from a first tank; an outlet for supplying the diesel exhaust fluid to a second tank; a shaft seal for separating the motor from the diesel exhaust fluid; an inverter assembly comprising a microcontroller; a bus connector; an inverter housing; a cooling pipe integrated into the inverter housing; wherein the microcontroller controls circulation of diesel exhaust fluid through the cooling pipe to pull heat away from the inverter assembly; and wherein the microcontroller shuts down the diesel exhaust fluid pump when pressure at the outlet of the diesel exhaust fluid pump is below a minimum fluid level threshold.

In this embodiment, the drive shaft bushing can comprise polyetheretherketone (PEEK); the drive shaft can comprise 316 stainless steel; the pump body insert can comprise 316 stainless steel; the plurality of gears can comprise 30 percent carbon-filled polyetheretherketone (PEEK); and the pump body cover can comprise 316 stainless steel.

In this embodiment, the shaft seal can further comprise a spring, a moving seal, and a shaft seal seat. In this embodiment, the shaft seal can further comprise a stationary portion comprising at least one material selected from the group consisting of 304 stainless steel, fluoroelastomer, ceramic, and silicon carbide and the moving seal of the shaft seal can comprise at least one material selected from the group consisting of 304 stainless steel, fluoroelastomer, ceramic, and silicon carbide.

In this embodiment, the plurality of gears can further comprise a drive gear and an idler gear.

In this embodiment, the diesel exhaust fluid pump can further comprise a plurality of first O-rings located at a cooling pipe interface; a plurality of second O-rings located at an interface of a wear plate and the pump body cover; a third O-ring located at an interface of the pump body cover and the pump body insert; and a fourth O-ring located at an interface of the pump body insert and the shaft seal seat.

In this embodiment, the plurality of first O-rings, the plurality of second O-rings, the third O-ring, and the fourth O-ring can comprise at least one material selected from the group consisting of ethylene propylene diene monomer (EPDM) and fluoroelastomer; or the plurality of first O-rings, the plurality of second O-rings, the third O-ring, and the fourth O-ring can comprise ethylene propylene diene monomer (EPDM); or the plurality of first O-rings, the plurality of second O-rings, the third O-ring, and the fourth O-ring can comprise fluoroelastomer.

In this embodiment, the diesel exhaust fluid pump can further comprise a plurality of bearing surfaces, and wherein the plurality of bearing surfaces comprises stainless steel on 30 percent carbon polyetheretherketone (PEEK).

In this embodiment, a centerline of the diesel exhaust fluid pump can be located above the first tank.

In this embodiment, the diesel exhaust fluid pump can further comprise a speed sensor for use in determining if the diesel exhaust fluid pump has a locked rotor; and a pressure sensor for use in determining if the diesel exhaust fluid pump is running dry.

In this embodiment, the speed sensor can be waterproof and the pressure sensor can be waterproof.

In this embodiment, the diesel exhaust fluid pump can further comprise a cover wear plate comprising work-hardened 316 stainless steel, wherein the cover wear plate is located between the pump body cover and the pump body housing; and means for removing the cover wear plate.

In this embodiment, the diesel exhaust fluid pump can further comprise a network bus connector for allowing the diesel exhaust fluid pump to communicate with a network bus in a vehicle. In this embodiment, the network bus connector can be a controller area network (CAN) bus connector; and the network bus can be a controller area network (CAN) bus.

In this embodiment, the diesel exhaust fluid pump can comprise means for breaking free crystalized urea from one or more surfaces of the diesel exhaust fluid pump.

In this embodiment, the diesel exhaust fluid pump can comprise at least one mounting foot for connecting the diesel exhaust fluid pump to a vehicle; a heat exchanger comprising a plurality of fins; and a plurality of drain holes.

In this embodiment, the diesel exhaust fluid pump can further comprise means for decreasing electromagnetic interference from the diesel exhaust fluid pump.

In this embodiment, the diesel exhaust fluid pump can further comprise means for preventing corrosion on a plurality of bearing surfaces.

In this embodiment, the diesel exhaust fluid pump can further comprise means for allowing the diesel exhaust fluid pump to survive ambient temperatures up to 300 degrees Fahrenheit.

In this embodiment, the diesel exhaust fluid pump can further comprise means for allowing the diesel exhaust fluid pump to withstand vibration.

In this embodiment, the diesel exhaust fluid pump can further comprise means for allowing the diesel exhaust fluid pump to withstand exposure to high-pressure and high-temperature washing fluid; and means for allowing the diesel exhaust fluid pump to withstand exposure to moisture.

In another embodiment, a diesel exhaust fluid pump comprises a motor comprising a plurality of Type-H stator windings; and a rotor; a plurality of shaft bushings; a drive shaft; a pump body cover; a shaft seal; a pump body housing; a pump body insert; a plurality of gears; an inlet for receiving a diesel exhaust fluid from a first tank; an outlet for supplying the diesel exhaust fluid to a second tank; an inverter assembly comprising a microcontroller; a bus connector; an inverter housing; and a cooling pipe integrated into the inverter housing; means for self-aligning the pump body housing to the motor; means for self-aligning the drive shaft and at least one of the plurality of gears; means for self-aligning the inverter assembly at an interface with the pump body cover; means for pumping the diesel exhaust fluid; means for preventing corrosion on a plurality of bearing surfaces; and means to stop pumping the diesel exhaust fluid when a pressure at the outlet of the diesel exhaust fluid pump is below a minimum fluid level threshold.

In this embodiment, the diesel exhaust fluid pump can further comprise means for self-priming the diesel exhaust fluid pump; and means for increasing wear resistance and decreasing friction of a plurality of bearing interfaces.

In an example method of cleaning the exhaust from diesel engines comprises providing a diesel exhaust fluid pump having an inlet that is connectable in fluid communication with a source of a diesel exhaust fluid, an outlet that is connectable in fluid communication with a selective catalytic reduction system, and a motor comprising a plurality of Type-H stator windings and a rotor; self-priming the diesel exhaust fluid pump; suctioning the diesel exhaust fluid from a first tank into the inlet using the motor, wherein the suction pressure is sufficient to lift the diesel exhaust fluid to the inlet of the diesel exhaust fluid pump when the diesel exhaust fluid pump is dry; pumping the diesel exhaust fluid to a second tank; and circulating an unused amount of the diesel exhaust fluid back to the first tank.

In this embodiment, the method can further comprise providing a speed sensor; sensing if the diesel exhaust fluid pump has a locked rotor using the speed sensor; and applying the maximum rated amperage to the motor to free the locked rotor and restart the diesel exhaust fluid pump.

In this embodiment, the method can further comprise providing a pressure sensor; detecting if the diesel exhaust fluid pump is running dry; and shutting down the diesel exhaust fluid pump.

In this embodiment, the method can further comprise providing a network bus connector for communicating with a network bus in a vehicle; receiving data from the vehicle through the network bus connector; and transmitting data to the vehicle through the network bus connector. In this embodiment, the network bus connector can be a controller area network (CAN) bus connector; and the network bus can be a controller area network (CAN) bus.

In this embodiment, the method can further comprise selecting a mode of operation of the diesel exhaust fluid pump with a controller area network (CAN) bus command.

DETAILED DESCRIPTION OF THE INVENTION

The following is a detailed description of exemplary embodiments to illustrate the principles of the invention. The embodiments are provided to illustrate aspects of the invention, but the invention is not limited to any embodiment. The scope of the invention encompasses numerous alternatives, modifications, and equivalents. The scope of the invention is limited only by the claims.

While numerous specific details are set forth in the following description to provide a thorough understanding of the invention, the invention may be practiced according to the claims without some or all of these specific details.

Various embodiments will be described in detail with reference to the accompanying drawings. Wherever possible, the same reference numbers will be used throughout the drawings to refer to the same or like parts. References made to particular examples and implementations are for illustrative purposes and are not intended to limit the scope of the claims.

Figure 1:
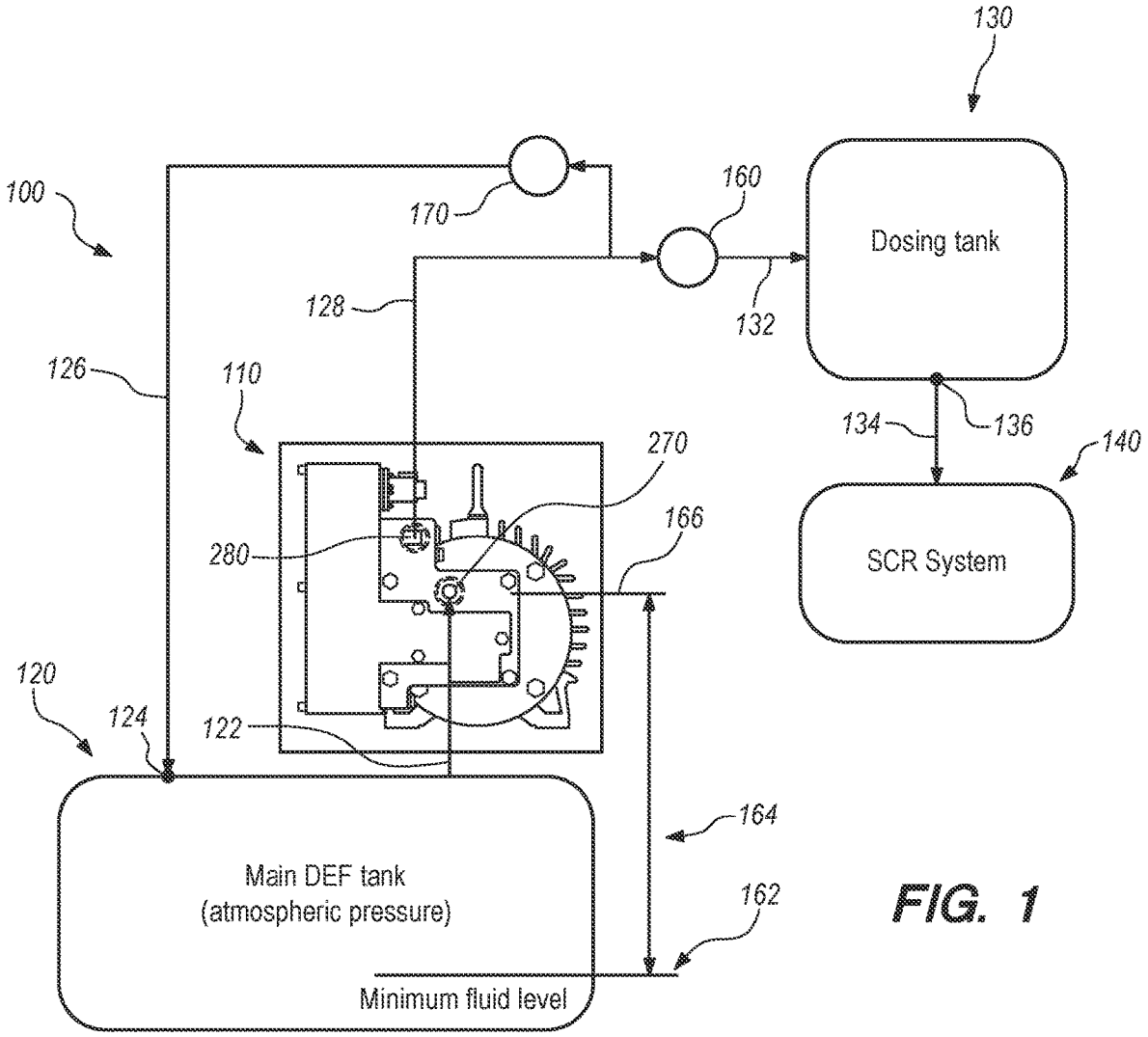
FIG. 1 illustrates a system block diagram of an example DEF pump system suitable for use with various embodiments.

FIG. 1 is a block diagram of an example system 100 including a DEF pump 110, main DEF tank 120, dosing tank 130, SCR system 140, flow control valve 160, and relief valve 170.

DEF pump 110 is connected to main DEF tank 120 via supply 122 to allow DEF pump 110 to pull, or suction, DEF from main DEF tank 120 into inlet 270. Outlet 280 of DEF pump 110 is connected to flow control valve 160 via supply line 128. Flow control valve 160 is connected to dosing tank 130 via supply line 132 to allow DEF to flow to dosing tank 130. The output 136 of dosing tank 130 is connected to SCR system 140 via supply line 134. Relief valve 170 is connected to input 124 of main DEF tank 120 via return line 126 to allow unused DEF to be returned to main DEF tank 120.

When a centerline 166 of DEF pump 110 is located above main DEF tank 120, DEF pump 110 is designed to self prime and operate even under conditions where the fluid level in main DEF tank 120 is at a minimum level, or threshold, and DEF pump interior parts are dry. The suction required to lift the fluid from the tank to inlet 270 is a function of a height 164 of DEF pump 110 above main DEF tank 120, atmospheric pressure pushing on the fluid in main DEF tank 120, and back pressure on outlet 280 of DEF pump 110. One of skill in the art will understand how to calculate the required suction.

Figure 2:
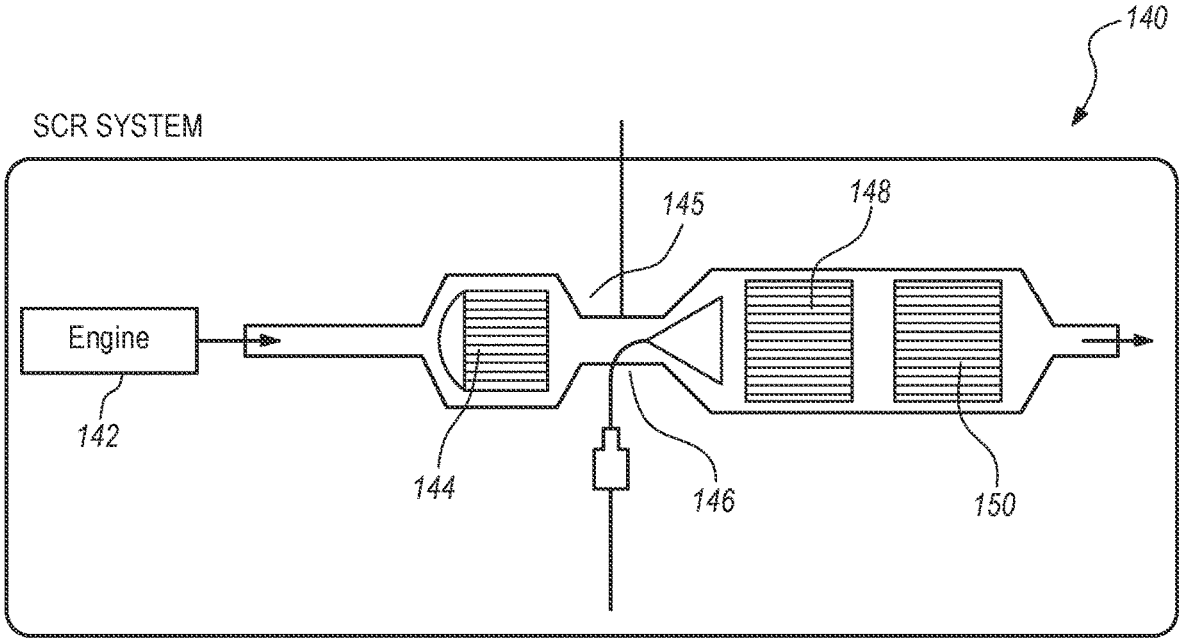
FIG. 2 illustrates an example SCR system.

FIG. 2 illustrates an example SCR system 140 including an input from engine 142, an oxidation catalyst 144, a urea dosing system 146, a urea SCR 148, and an $NH_2$ oxidate catalyst 150.

Engine 142 is connected to oxidation catalyst 144. The output of oxidation catalyst 144 to connected to urea dosing system 146, which in turn is connected to urea SCR 148. Supply line 134 from dosage tank 130 is connected to the input of urea dosing system 146. Urea SCR 148 is connected to $NH_2$ oxidate catalyst 150.

FIGS. 3-6 illustrate an example DEF pump 110 including an inverter assembly 210, inverter housing 212, speed sensor 220, pressure sensor 230, CAN connector 240, inverter cooling pipe 250, mounting feet 260, inlet 270, outlet 280, lifting ring 282, power connector 284, and motor 290.

Inverter assembly 210 comprises a microcontroller 211 and memory 213. In one embodiment, inverter assembly 210 is a PWM inverter assembly such as the design disclosed in U.S. Pat. No. 8,707,932, which is incorporated herein in its entirety.

Inverter cooling pipe 250 is integrated into inverter housing 212 to allow DEF to flow past the most sensitive and highest heat-producing electronic parts in inverter assembly 210, such as MOSFETs, pulling heat away in the process. In one embodiment, inverter cooling pipe 250 comprises stainless steel.

Figure 3:
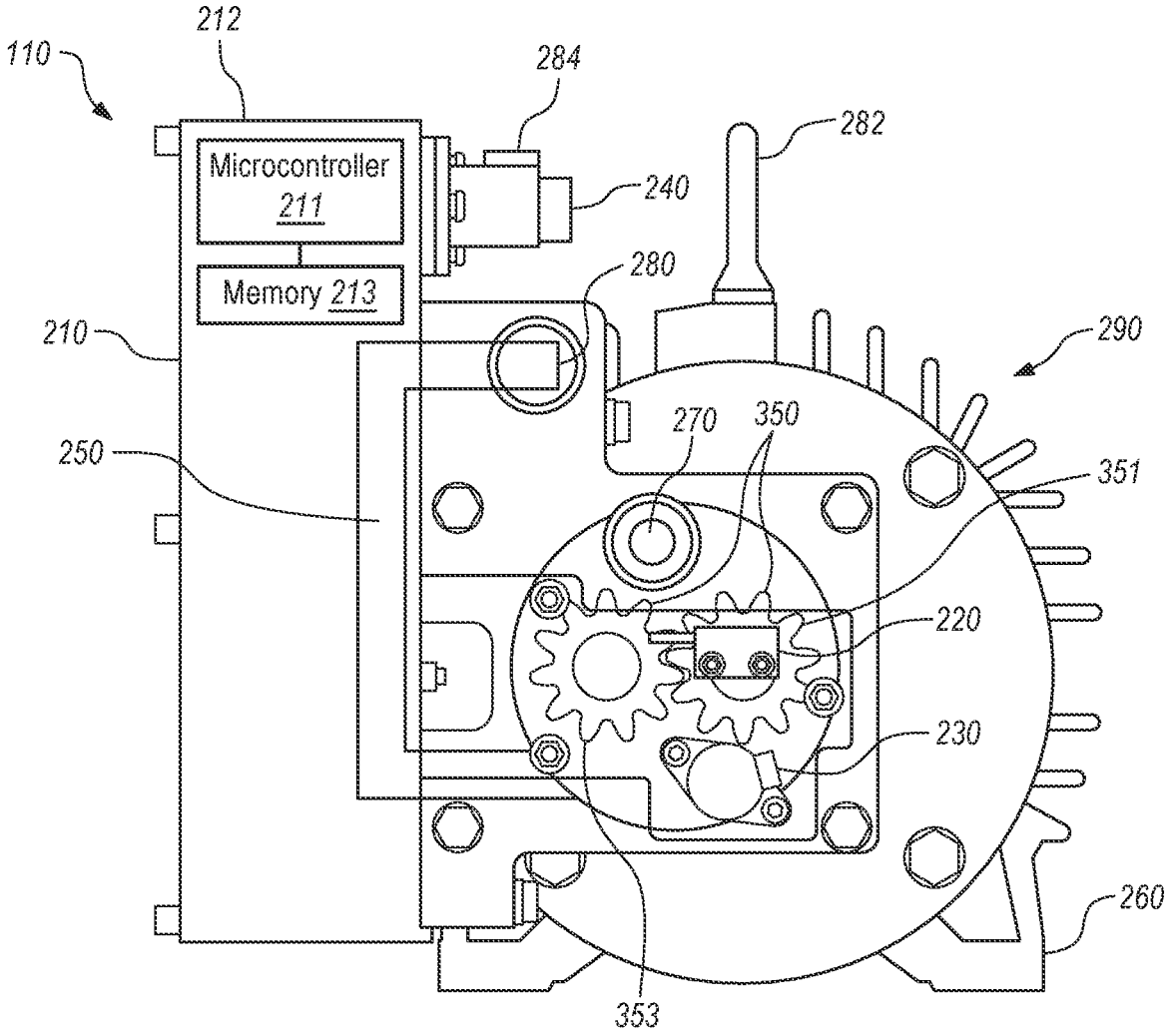
FIG. 3 illustrates an example DEF pump.
Figure 4:
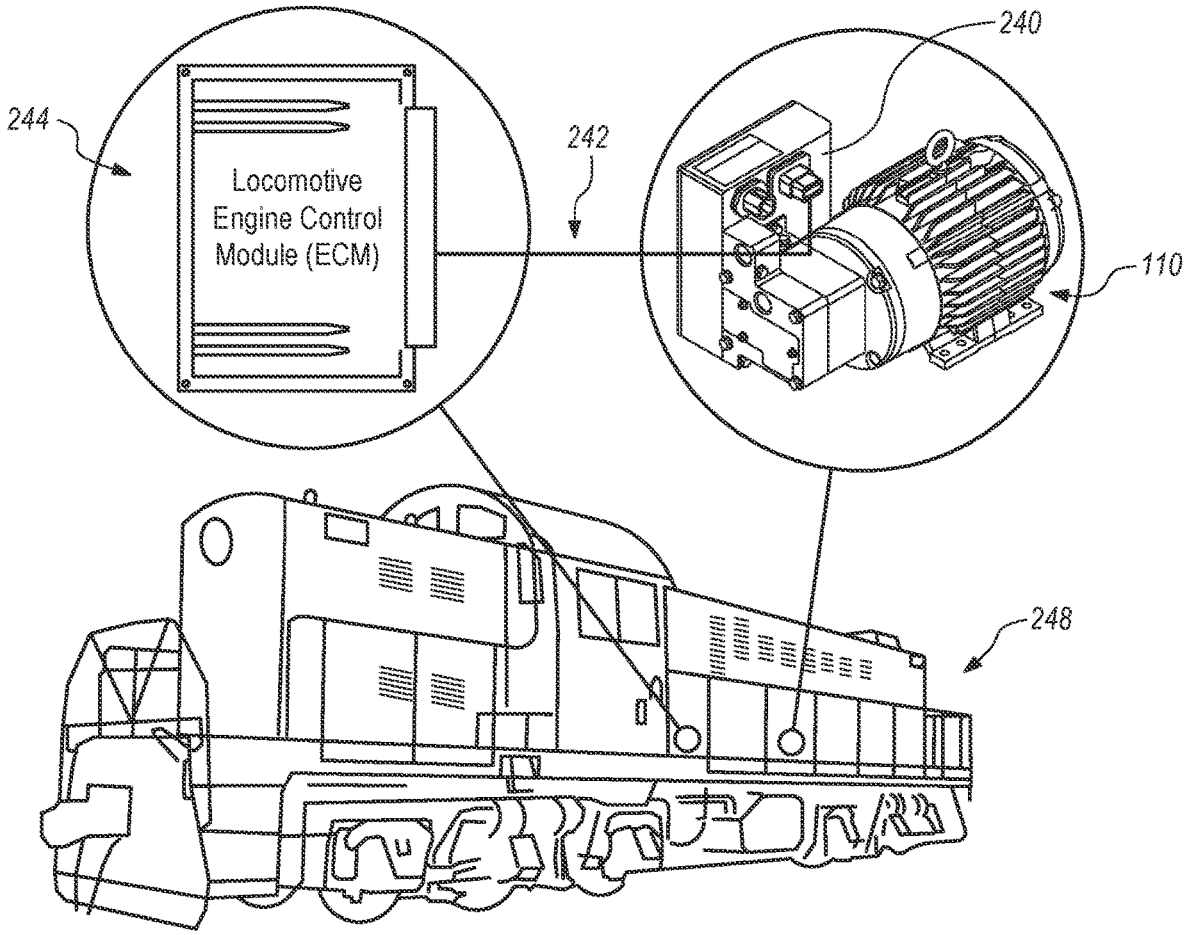
FIG. 4 illustrates an example DEF pump connected to an ECM in a vehicle via a CAN bus.

As shown in FIG. 3, inverter assembly 210 is used to control DEF pump 110, which has a bus communication capability, such as a CAN bus communication capability, that will allow DEF pump 110 to be connected to a Controller Area Network (CAN bus) 242, or other network, in a vehicle 248 (as shown in FIG. 4). A CAN connector 240 is integrated into inverter housing 212. In one embodiment, connector 240 comprises materials such as thermoplastic or polyimide to make it environmentally rugged.

FIG. 4 illustrates DEF pump 110 may be connected to a vehicle 248, such as a locomotive, that has an engine control module (ECM) 244, which is a computer system that analyzes data and controls numerous aspects of the vehicle's performance. In one or more embodiments, vehicle 248 has a CAN bus 242, which is a bus standard allowing microcontrollers and other devices to communicate with each other using a message-based protocol. DEF pump diagnostics can be transmitted from inverter assembly 210 to ECM 244 via CAN bus 242, which can be connected to inverter assembly 210 with connector 240.

Multi-mode control of DEF pump 110 can be achieved using CAN bus commands. Modes of operation may include, among others, standby, high-speed priming, running, reverse or purge, closed-loop pressure control, or open-loop speed control.

As shown in FIG. 3, mounting feet 260 may be attached to motor 290 and can be used to attach DEF pump 110 to a vehicle 248 (FIG. 4).

Figure 6:
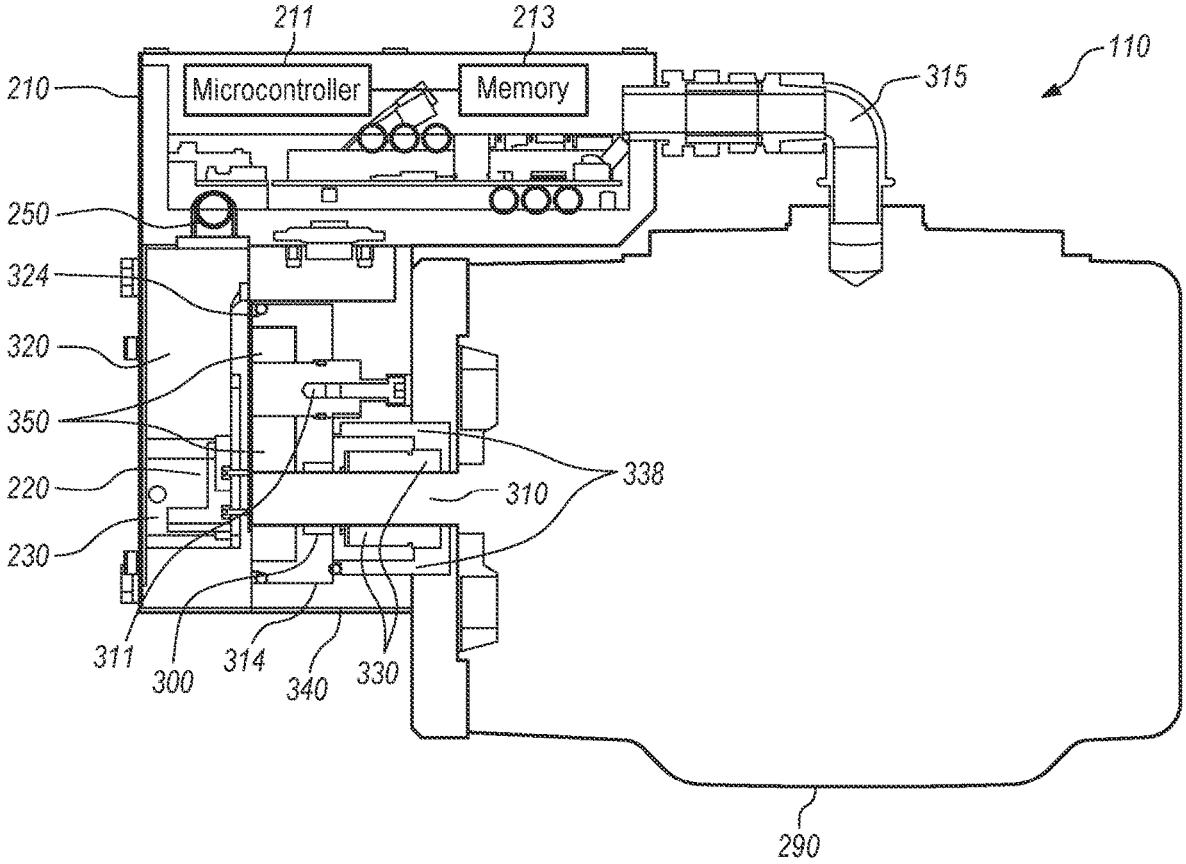
FIG. 6 illustrates an internal view of an example DEF pump.

FIG. 6 shows an example DEF pump 110 comprising drive shaft bushings 300, drive shaft 310, pump body cover (fluid manifold) 320, shaft seal 330, shaft seal seat 338, pump body housing 340, pump body insert 314, gears 350, inverter assembly 210, and motor 290. Motor 290 comprises a rotor (not shown). In one or more embodiments, drive shaft bushings 300 are PEEK bushings.

Motor 290 is separated from the pumping fluid (DEF fluid) because of the fluid's corrosiveness and conductivity. The separation is accomplished with a mechanical shaft seal 330. Since motor 290 cannot be cooled with the pumping fluid, Type-H stator windings are used to provide the highest standard temperature rating for motor 290.

In one embodiment, motor 290 is oversized relative to the pumping requirement for normal operation so that DEF pump 110 is more capable of breaking free from crystalized urea. For example, in one embodiment, motor 290 has a 0.5 Hp rating and produces 5.9 foot-pounds of torque at 0 RPM despite the need for only 0.03 Hp and 0.2 foot-pounds of torque necessary for producing 2 gpm at 10 psi.

Figure 5:
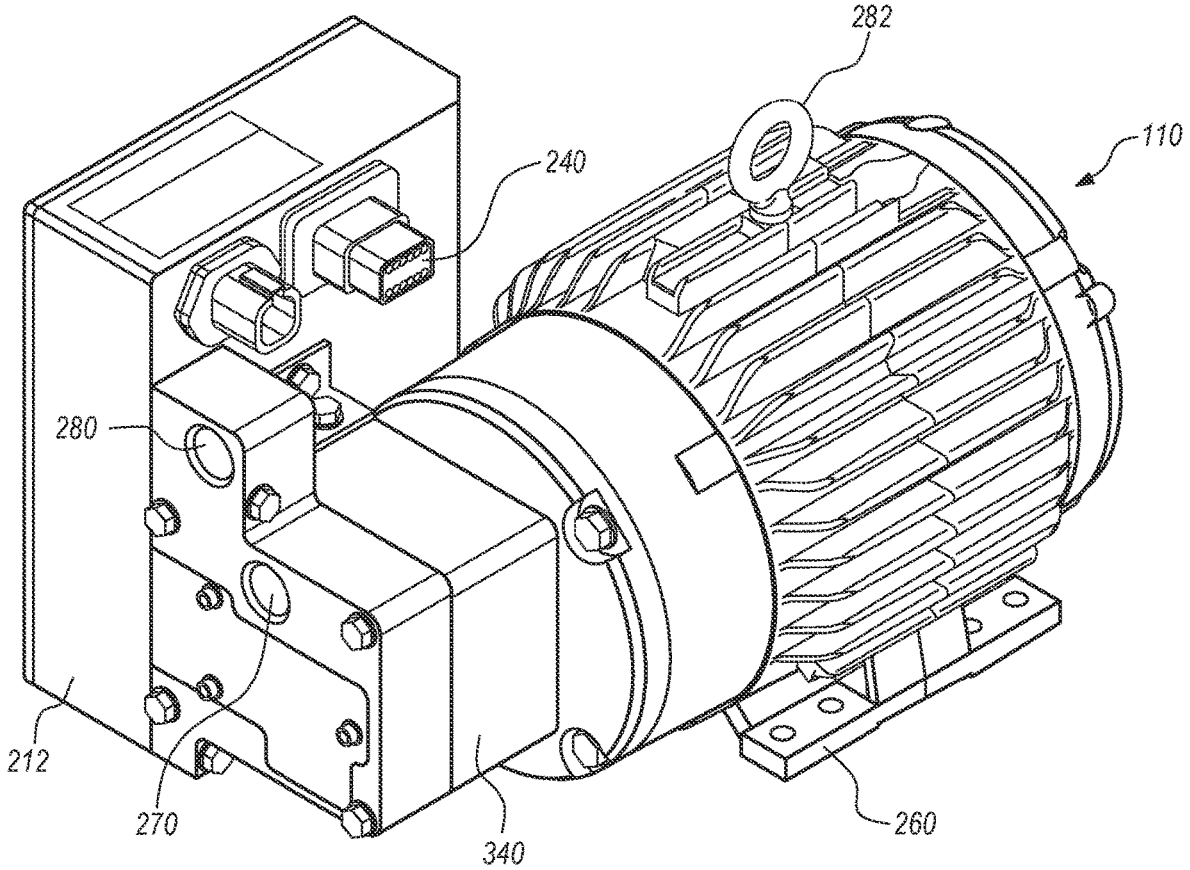
FIG. 5 illustrates an external view of an example DEF pump.
Figure 7:
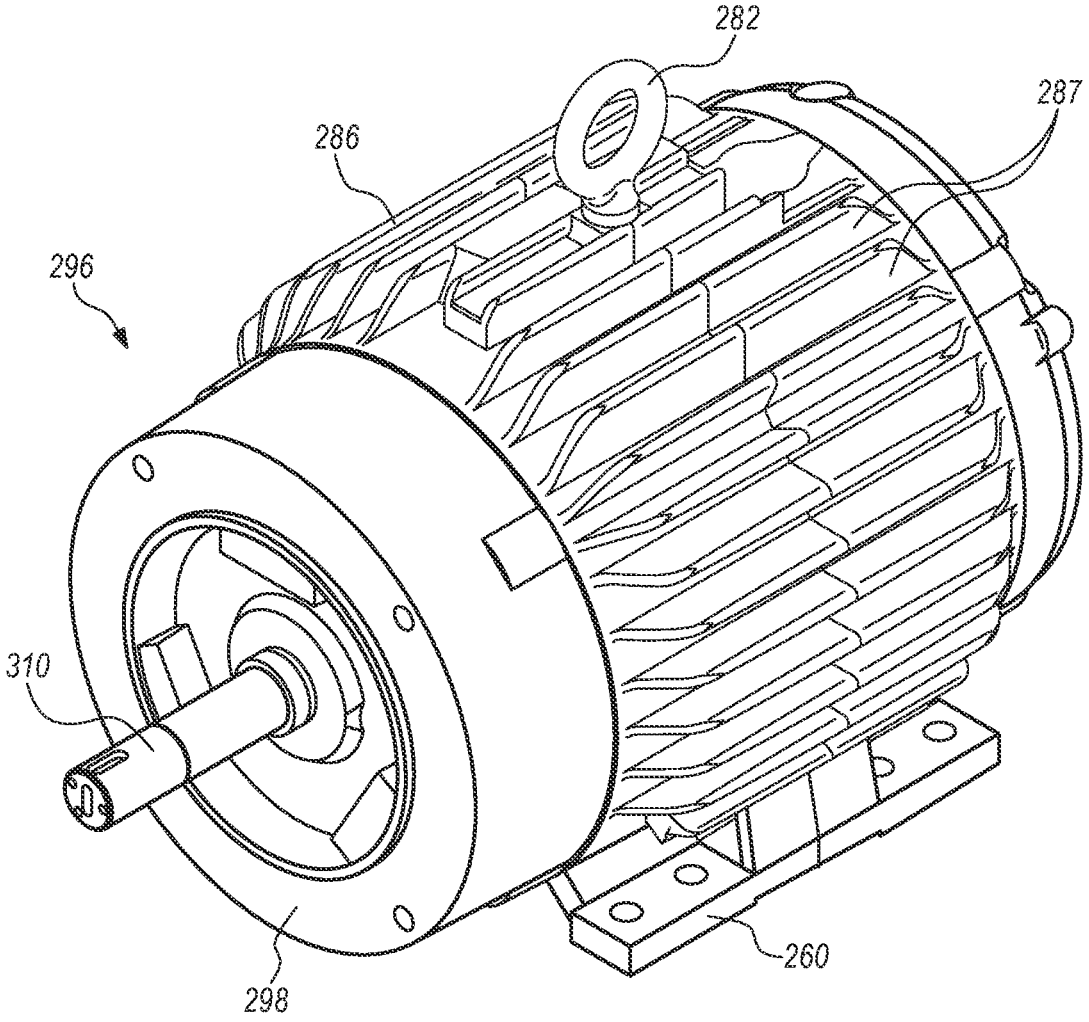
FIG. 7 illustrates an example motor frame for an example DEF pump.

As shown in FIG. 7, a robust motor frame 296 allows pump body housing 340 and inverter housing 212 (as shown in FIGS. 5 and 6) containing inverter assembly 210 to be mounted directly to front of motor 290, and motor 290 to be mounted directly to a chassis of vehicle 248, such as the chassis of a locomotive. Motor frame 296 comprises mounting feet 260 that are integrated into a solid cast housing of motor frame 296 and a motor mounting face 298. In one or more embodiments, motor frame 296 further comprises a heat exchanger 286 for improved passive cooling and a shaft 310. In one or more embodiments, heat exchanger 286 comprises fins 287. In one or more embodiments, shaft 310 is a 316 stainless steel shaft. This design increases the manufacturability of DEF pump 110, and eliminates the need for shimming in most cases.

By designing the parts of DEF pump 110 to be self-aligning, shimming is not required and no special measurements are required for aligning the parts during manufacture. To eliminate alignment issues, an assembly can be used where motor shaft 310 extends all the way into pump body housing 340 and into a drive gear 351 (FIG. 3), and applies torque via a shaft key (not shown) as opposed to a press-fit interface. This configuration eliminates the need for a separate pump head shaft and a rotating coupling to connect motor shaft 310 to the pump head shaft and the associated alignment challenges. Gears 350 shown in FIG. 3 comprise a drive gear 351 (right gear) and an idler gear 353 (left gear). Pump body housing 340 mounts directly to motor mounting face 298.

DEF pump 110 is able to prime itself when dry because of the design and tolerances of gears 350, pump body cavity (not shown), which is the cavity in the pump body insert in which the gears are located, and various seal interfaces. For example, in one or more embodiments, gears 350, pump body insert 314, wear plate 324, and pump body cover 320 are designed with tolerances so that there is 0.0005-0.002 inches of clearance between gears 350 and all surrounding walls of pump body insert 314. The ability to vary the speed of DEF pump 110 and run it at a higher-than-required speed for a fixed amount of time or until pressure at outlet 280 of DEF pump 110 is above a specified threshold also improves the ability of DEF pump 110 to self-prime.

A DEF-specific pressure sensor 230 can be integrated into the outlet side of DEF pump 110. This will allow microcontroller 211 in inverter assembly 210 to determine if the pump is running dry, as well as achieve closed-loop pressure control if necessary.

A speed sensor 220 can be integrated into DEF pump 110. In one or more embodiments, speed sensor 220 is a hall-effect speed sensor. Speed sensor 220 and a set of magnets (not shown) potted into drive shaft 310 allow microcontroller 211 in inverter assembly 210 to monitor the speed of gears 350 and detect if DEF pump 110 has seized. If DEF pump 110 has seized and a "locked-rotor" is detected, microcontroller 211 in inverter assembly 210 will attempt to restart DEF pump 110 using higher current for a specified amount of time, and then rest for a specified amount of time to cool down. DEF pump 110 repeats this process until it is shut off. This prevents motor 290 and inverter assembly 210 from overheating and potentially damaging other components. It also increases the likelihood of DEF pump 110 recovering from urea crystallization without having to be flushed with clean water.

Figure 8:
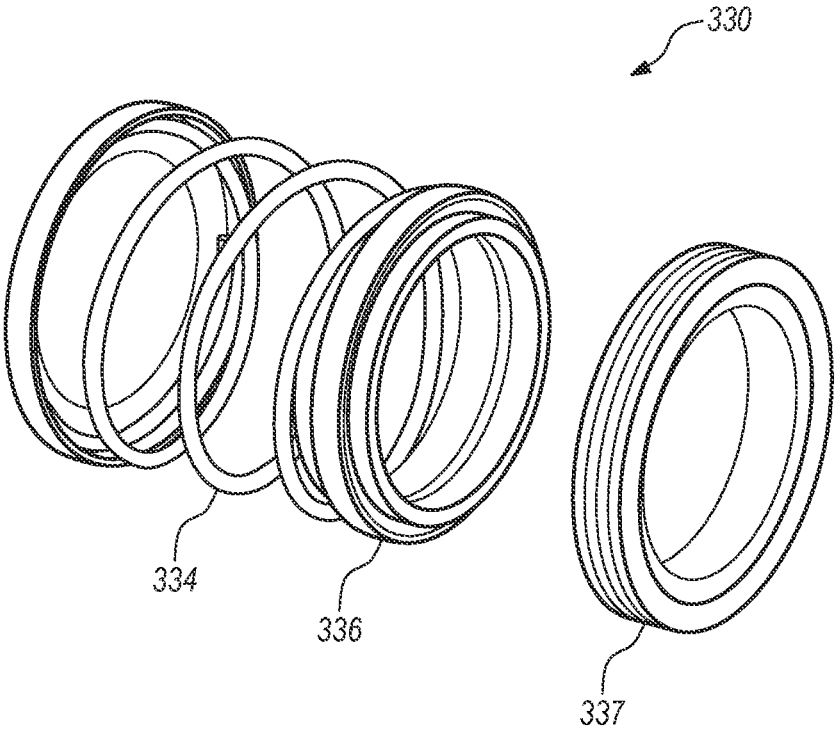
FIG. 8 illustrates an example shaft seal for an example DEF pump.

The selection of corrosive-resistant materials for parts of DEF pump 110 that come into contact with DEF can prevent or limit corrosion. In one or more embodiments, pump body insert 314 comprises 316 stainless steel. In one or more embodiments, gears 350 comprise 30 percent carbon-filled PEEK. In one or more embodiments, pump body cover 320 comprises 316 stainless steel. As illustrated in FIG. 8, shaft seal 330 comprises a spring 334, a moving portion 336, and a stationary portion 337. In one or more embodiments, spring 334, moving portion 336, and stationary portion 337 each comprises 304 stainless steel, fluoroelastomer, ceramic, and/or silicon carbide. In one embodiment, spring 334 in shaft seal 330 comprises 304 stainless steel because 304 stainless provides a good balance between corrosion resistance and suitability for springs. Stationary portion 337 of shaft seal 330 is pressed into shaft seal seat 338 (FIG. 6). Stationary portion 337 of shaft seal 330 comprises one face of the rotating face-to-face seal interface that comprises silicon carbide or ceramic.

Stationary portion 337 of shaft seal 330 comprises fluoroelastomer, ceramic, and/or silicon carbide, and moving seal 336 comprises fluoroelastomer, ceramic, and/or silicon carbide. In one or more embodiments, inverter cooling pipe 250 comprises 316 stainless steel.

Figure 9:
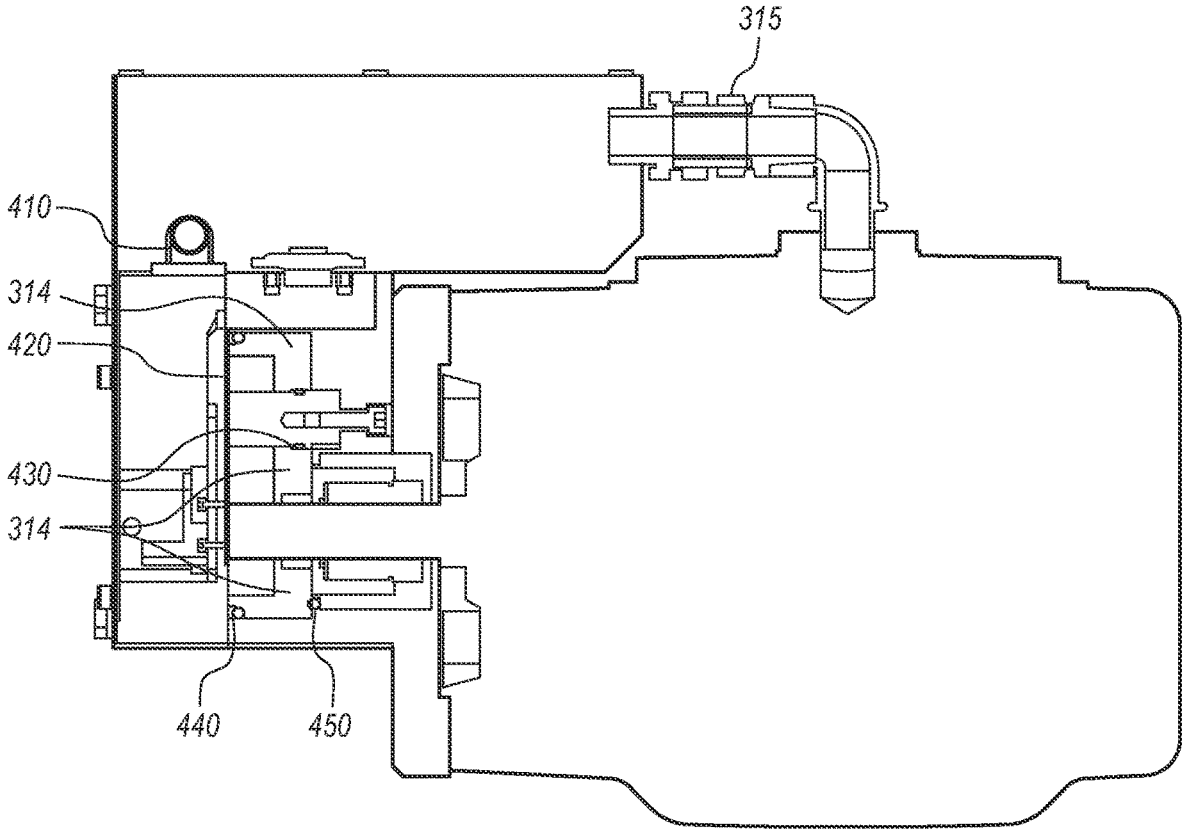
FIG. 9 illustrates interfaces with O-rings in an example DEF pump.

As shown in FIG. 6, in one or more embodiments, two O-rings (not shown) are used at an interface between cooling pipe 250 and pump body cover 320. As shown in FIG. 9, in one or more embodiments, three O-rings (not shown) are used at a wear plate to pump body cover interface 420. In one or more embodiments, one O-ring is used at an idler shaft to pump body insert interface 430. In one or more embodiments, one O-ring is used at a pump body cover to pump body insert interface 440. In one or more embodiments, one O-ring is used at a pump body insert to shaft seal seat interface 450. In one or more embodiments, the O-rings comprise EPDM or fluoroelastomer. The O-rings provide seals.

Stainless steel moving on stainless steel can cause galling, and plastic running on plastic can cause plastic welding. Therefore, in one or more embodiments, all bearing interfaces, except shaft seal 330, utilize dissimilar material pairing (i.e., stainless steel running on PEEK or vice-versa). PEEK does not readily absorb water and is dimensionally stable over a large temperature range. In one or more embodiments, the PEEK is 30 percent carbon to increase wear resistance and decrease friction.

Figure 10:
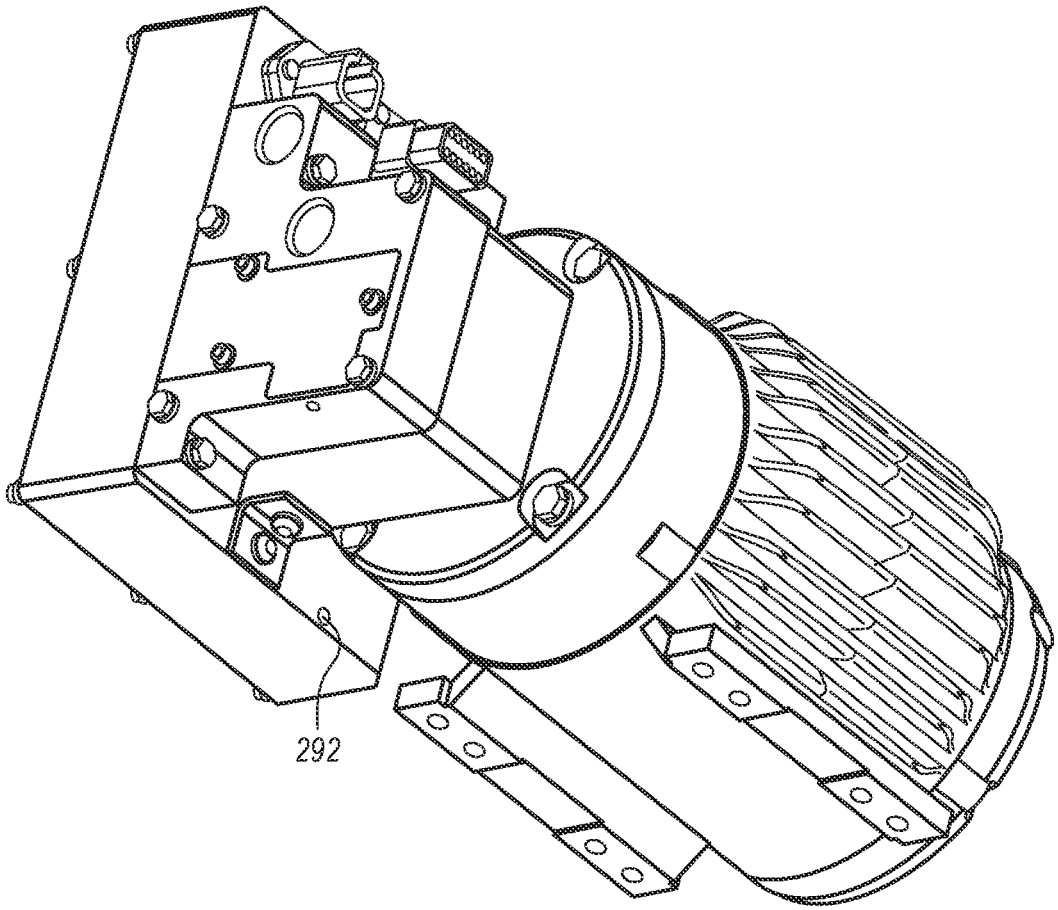
FIG. 10 illustrates an elevation view of an example drain port, or drain hole, in the inverter assembly of an example DEF pump.
Figure 11:
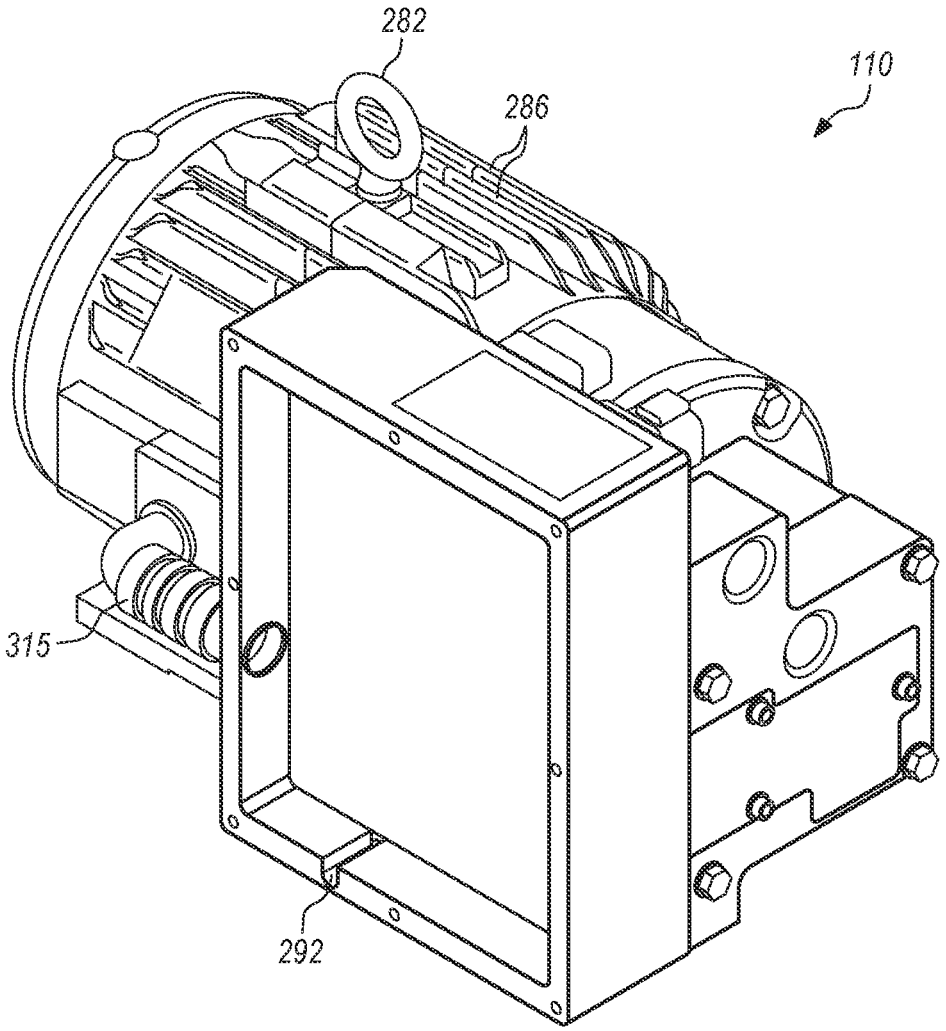
FIG. 11 illustrates another elevation view of an example drain port, or drain hole, in the inverter assembly of an example DEF pump.
Figure 12:
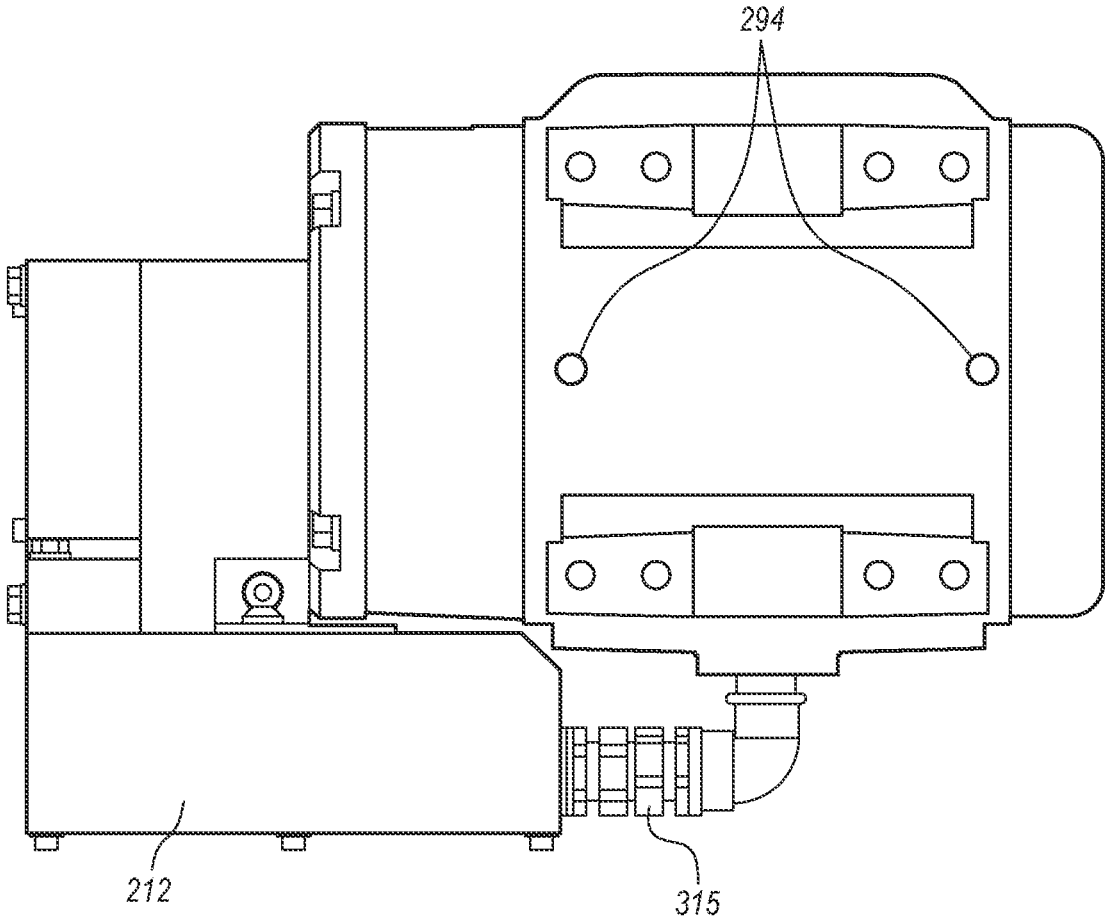
FIG. 12 illustrates example drain ports, or drain holes, in the motor of an example DEF pump.

DEF pump 110 is designed to achieve IP67 minimum ingress protection rating, but also allow any moisture collected inside electrical components, such as motor 290 and inverter assembly 210, to drain via strategically placed drain ports, or drain holes. FIGS. 10 and 11 show an inverter drain port 292, and FIG. 12 shows motor drain ports 294. In one or more embodiments, drain ports 292, 294 are labyrinthed.

The inverter electronics are fully potted. In one or more embodiments, speed sensor 220 and pressure sensor 230 are waterproof.

Figure 13:
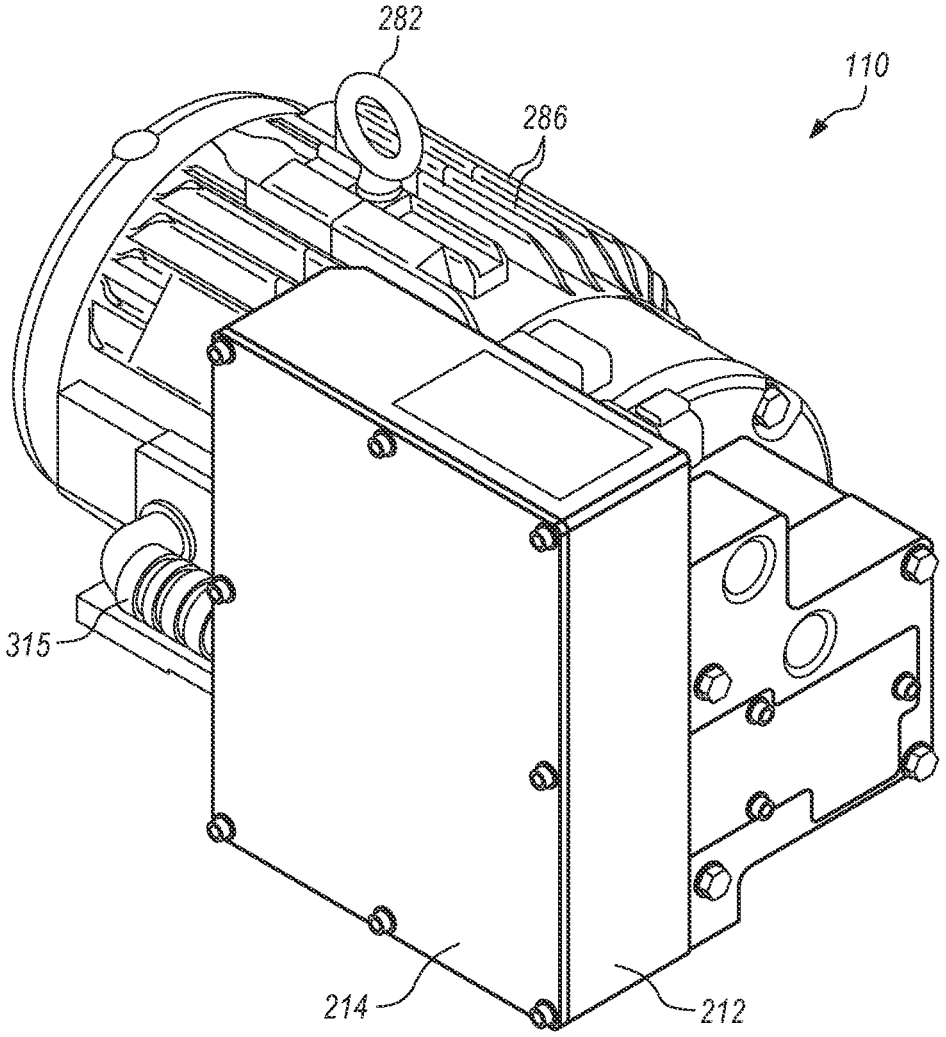
FIG. 13 illustrates an example inverter housing and cover of an example DEF pump.

In one or more embodiments, DEF pump 110 is designed so that components most prone to wear during pump operation, such as pump body insert 314, cover wear plate 324, and gears 350, are easily removable and relatively inexpensive to replace reducing the cost and level of effort required to refurbish DEF pump 110. The method of attachment, simplicity, and size of cover wear plate 324 make it easy to remove. In one or more embodiments, cover wear plate 324 comprises a 4 inch by 5 inch by 0.020 inch thick, work-hardened, 316 stainless steel sheet and is held in place by four screws that clamp it between pump body cover 320 and pump body housing 340. Gears 350 are easy to remove because they simply slide off drive shafts 310 and idler shaft 311 (FIG. 6) once pump body cover 320 and cover wear plate 324 are removed To decrease EMI radiating from DEF pump 110, all main components should be well connected electrically to each other according to a planned grounding scheme. Inverter housing 212, shown in FIGS. 3 and 12, can comprise aluminum and inverter cover 214, shown in FIG. 13 can be anodized aluminum. However, in one or more embodiments, portions of these parts can be masked before anodization or machined after anodization so that their various part-to-part interfaces provide good electrical conduction and minimize EMI leakage. In one or more embodiments, for all the aluminum parts, if a particular part-to-part interface serves as an electrical conductor (ground path), the anodization is left off in that area. For example, in one or more embodiments, portions of aluminum inverter cover 214 and inverter housing 212 can be masked. This masking may be done on various areas on inverter housing 212 and on the portion of inverter cover plate 214 that comes in direct contact with inverter housing 212.

In an alternate embodiment, inverter housing 212 can comprise stainless steel. The advantage to using stainless steel is that the cooling DEF flow could be run directly through ports in inverter assembly 210 eliminating the need for inverter cooling pipe 250. The downside is that it would be heavier and more expensive compared with an aluminum housing.

Figure 17:
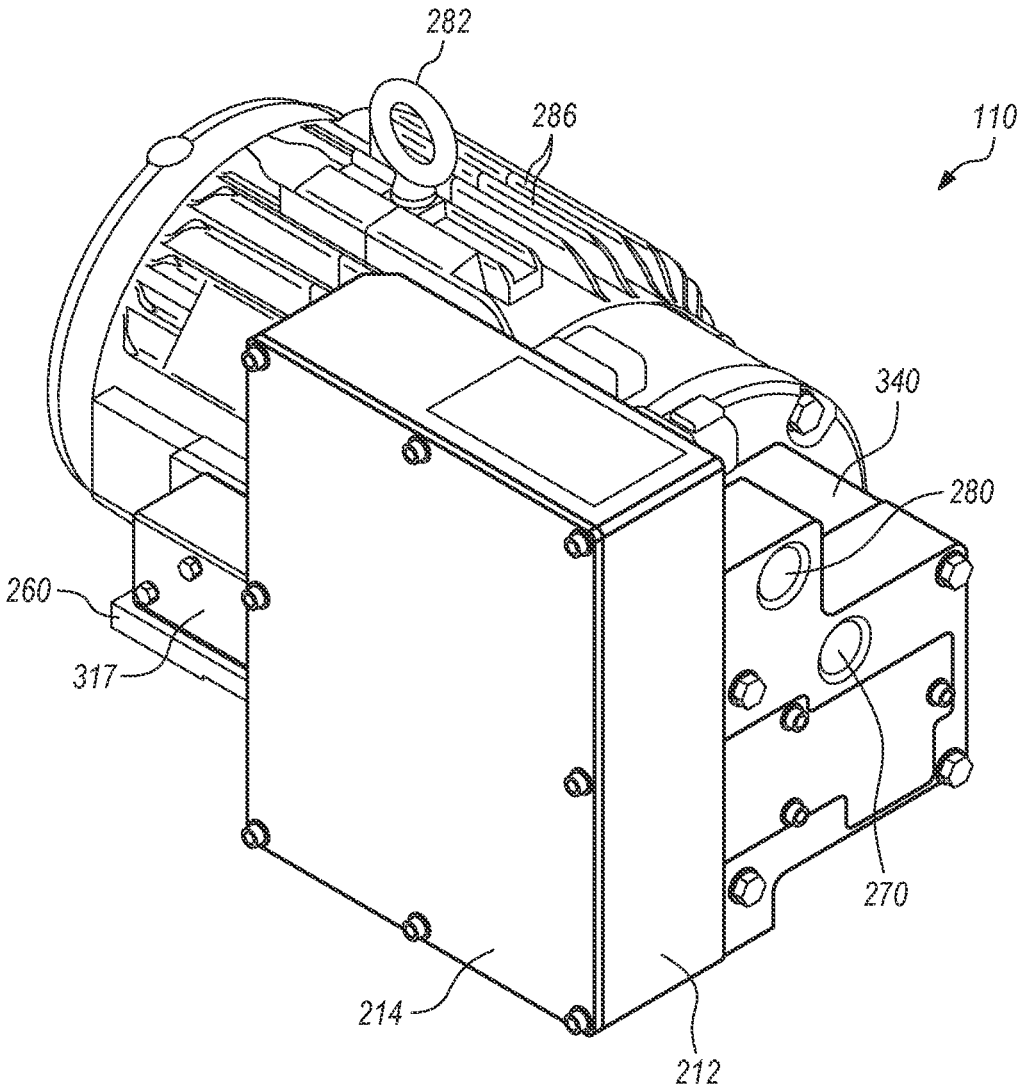
FIG. 17 illustrates an example DEF pump with a sheet metal cover enclosing motor phase wires.

In one embodiment, the motor phase wires are enclosed in a metal conduit 315 (FIG. 6) that protects the motor phase wires and minimizes EMI radiation. In an alternate embodiment, the motor phase wires are enclosed in a sheet metal cover 317 (FIG. 17) that protects the motor phase wires and minimizes EMI radiation. Sheet metal cover 317 shown in FIG. 17 can be used in place of metal conduit 315 in any of the disclosed embodiments.

In one or more embodiments, DEF pump 110 is designed to be able to survive sub-zero Fahrenheit ambient temperatures and ambient temperatures above 150 degrees Fahrenheit for continuous operation.

In one or more embodiments, the combination of the type-H motor stator windings (not shown), inverter cooling pipe 250 that flows DEF next to the power electronics in inverter assembly 210, and materials allow the pump to be able survive high ambient temperatures, such as temperatures up to 300 degrees F., for short durations, such as at least 30 minutes.

In one or more embodiments, DEF pump 110 can endure a high vibration environment. Screw lengths, screw strengths, number of screws, location of screws, size of screws are selected to withstand substantial vibration. Materials and material finishes chosen are selected to withstand substantial vibration. Motor frame 296 with integrated mounting feet 260 withstands vibration better than prior art implementations that used a lighter-duty motor with sheet metal mounting feet 260. In one or more embodiments, all electrical connections are minimum IP67 rated.

In one or more embodiments, DEF pump 110 can endure exposure to rain and snow, exposure to high-pressure and high-temperature engine washing fluid, and exposure to dust and iron particles. In one or more embodiments, drain ports 292, 294 are placed in strategic locations in case moisture does makes its way into locations that are sensitive to moisture. Further, in one or more embodiments, drain ports 292, 294 have a labyrinth design so that high-pressure washing cannot reach sensitive components.

DEF pump 110 is capable of meeting the performance requirements for a typical locomotive life-to-engine-rebuild. In an example embodiment, DEF pump 110 is designed to last for at least six years and/or 30,000 hours, and DEF pump 110 is designed to withstand 50,000 start/stop cycles.

As shown in FIG. 1, when in operation, DEF pump 110 pulls DEF from a large tank (e.g., a main DEF tank) 120, pumps DEF to a smaller tank (e.g. a dosing tank) 130, and circulates unused DEF back to large tank 120.

Figure 14:
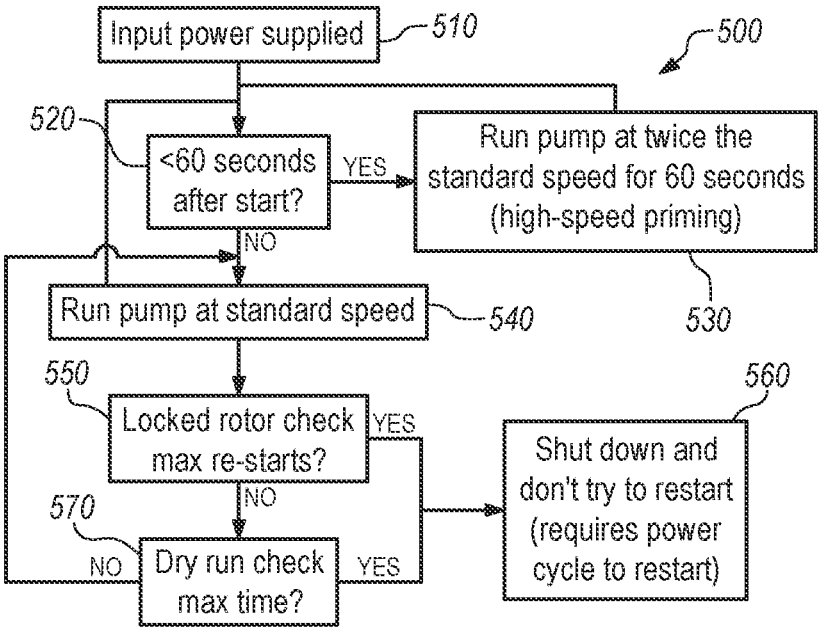
FIG. 14 is a flow diagram illustrating an example main loop for controlling a DEF pump.

FIG. 14 is a flow diagram illustrating an example control process 500 for controlling inverter assembly 210 to control DEF pump 110. Input power is supplied at Step 510. Then in Step 520 microcontroller 211 determines whether it has been less than a specified time period, such as 60 seconds, since DEF pump 110 was started. If it has been less than the specified time period since DEF pump 110 was started, high-speed priming is performed in Step 530, which means DEF pump 110 runs at twice the standard speed for the specified time period and then control loops back to Step 520. If in Step 520, it is determined that DEF pump 110 has been running for the specified time period or longer, then the process proceeds to Step 540 and DEF pump 110 is run at standard speed.

At Step 550, microcontroller 211 tests for locked rotor check max re-starts. If the result of the test in Step 550 is yes, then control proceeds to Step 560 and the microcontroller 211 shuts down DEF pump 110, and microcontroller 211 does not try to restart DEF pump 110. To restart DEF pump 110 after being shut down in Step 560, power must be cycled. If the result of the test in Step 550 is no, then control proceeds to Step 570 and microcontroller 211 tests the dry run check max time.

In one or more embodiments, microcontroller 211 uses control process 500 to determine if the rotor is locked. If the rotor is locked, DEF pump 110 will cycle between trying to restart for a specified time period, such as 5 seconds, and resting for a period of time, such as 5 seconds. DEF pump 110 cycles between trying to restart and resting for 5 minutes. After 5 minutes, it will stop, requiring a cycling power off and on to restart.

In one or more embodiments, there is a flag for a "locked rotor", a counter to record the number of restart attempts, and a flag to indicate when the number of restart attempts equals the maximum number of allowed tries. This keeps the motor and electronics from overheating.

In one or more embodiments, there is a flag for a "dry run" condition. In one or more embodiments, if this flag is high, or set, for a specified time period, such as 2 minutes, DEF pump 110 will shut down, at which point another flag will be set high indicating that DEF pump 110 has been shutdown due to an extended time running dry. This condition also requires a power cycle, or turning power off and on again, to clear the flags and restart. This prevents excessive wear of DEF pump 110 components due to dry running and/or overheating because there is no fluid cooling when DEF pump 110 is dry running.

If the result of the test in Step 570 is no, then control proceeds to Step 540. If the result of the test in Step 570 is yes, then control proceeds to Step 560.

In one embodiment, the main loop repeatedly checks whether the specified time period, such as 60 seconds, has passed since startup and determines how fast to run DEF pump 110 based on the result of that test. In another embodiment, an input to the pressure sensor is used to vary DEF pump 110 speed to attain a pressure target (see FIG. 15).

Figure 15:
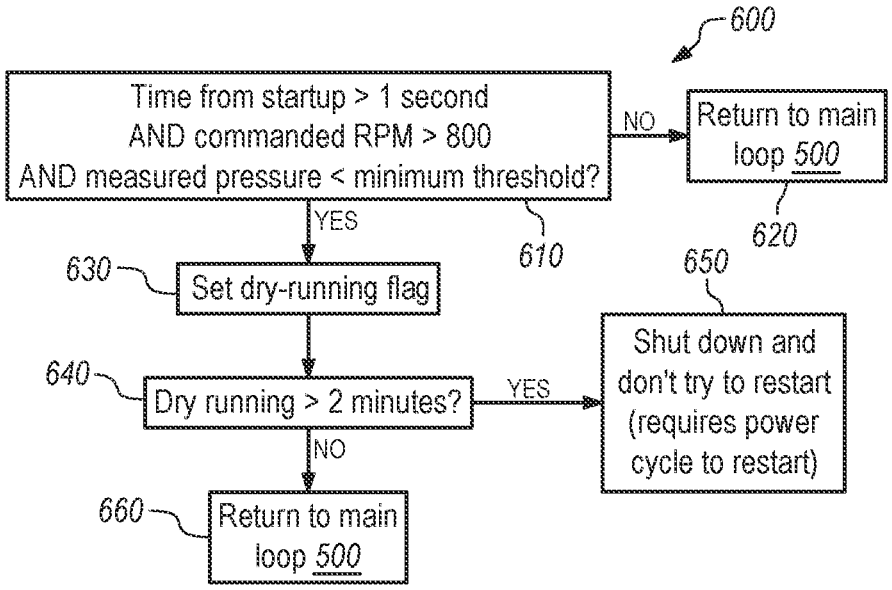
FIG. 15 is a flow diagram illustrating an example dry-running diagnostic.

FIG. 15 is a flow diagram for an example dry-running diagnostic 600. Step 610 checks whether the time since DEF pump 110 was started is greater than a specified time period, such as 1 second, commanded RPM is greater than a specified number of revolutions, such as 800, and measured pressure at outlet 280 is less than a minimum threshold. If the result of any of the tests in Step 610 is no, then Step 620 causes the system to return to main loop 500. If the result of all of the tests in Step 610 is yes, then in Step 630 the dry-running flag is set and control proceeds to Step 640. In Step 640, microcontroller 211 tests whether DEF pump 110 has been dry running greater than a specified time period, such as 2 minutes. If the result of the test in Step 640 is yes, then in Step 650 DEF pump 110 is shut down, and microcontroller 211 does not try to restart DEF pump 110. Power will have to be cycled to restart DEF pump 110 after it is shut down in Step 650. If the result of the test in Step 640 is no, then in Step 660 control returns to main loop 500.

Figure 16:
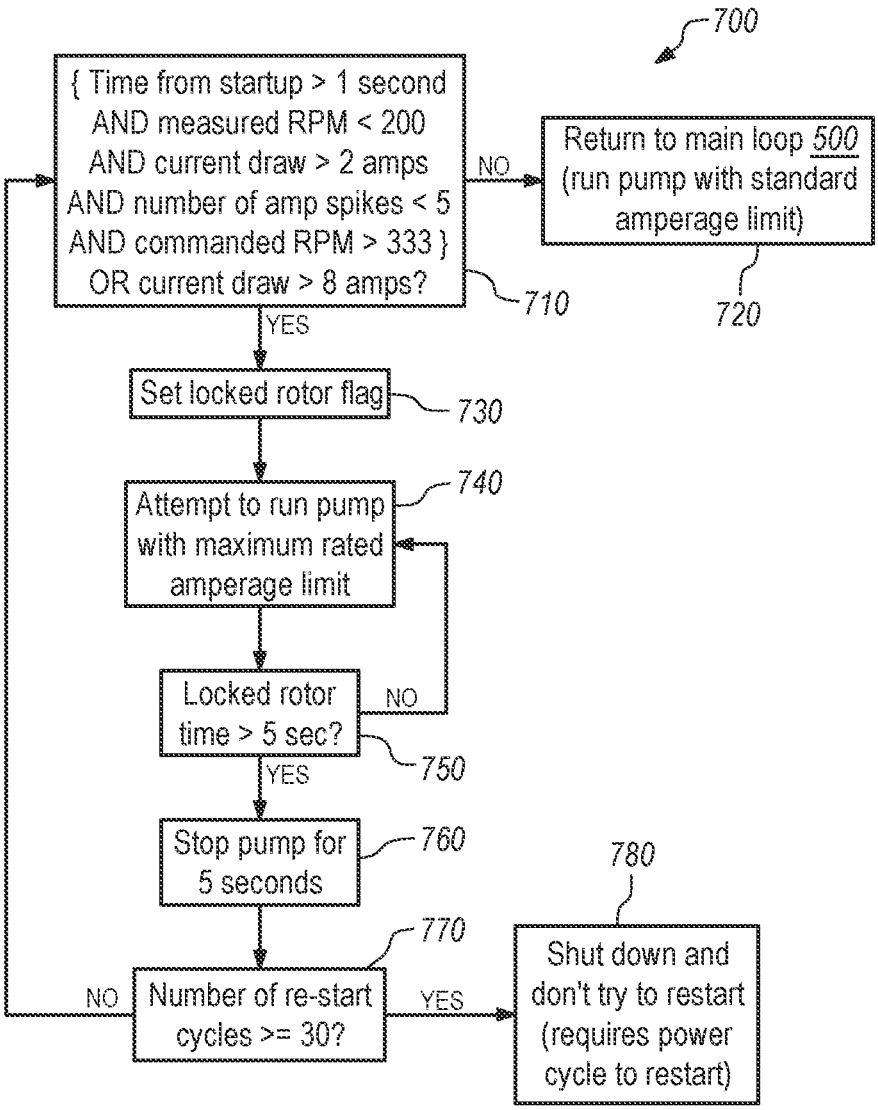
FIG. 16 is a flow diagram illustrating a locked-rotor diagnostic.

FIG. 16 is a flow diagram for an example locked-rotor diagnostic 700. In Step 710, microcontroller 211 tests whether the time to startup is greater than a specified time period, such as 1 second, measured RPM is less than a specific number of revolutions, such as 200, current draw is greater than a specific current, such as 2 amps, number of amp spikes is less than a specific number, such as 5, and commanded RPM is greater than a specific number of revolutions, such as 333. The 2 amp threshold is compared to a rolling average of the measured current. An amperage spike is counted when the instantaneous amperage goes over a different threshold, which in one example embodiment is 3 amps. If all of the conditions are met or if the current draw is greater than a current threshold, such as 8 amps, then the result of the Step 710 test is yes, or true. If the result of the test in Step 710 is no, then in Step 720 control returns to main loop 500 to run DEF pump 110 with the standard amperage limit. If the result of the test in Step 710 is yes, then in Step 730 the locked rotor flag is set and then control proceeds to Step 740. In Step 740, microcontroller 211 attempts to run DEF pump 110 with the maximum rated amperage limit and then control proceeds to Step 750. In Step 750, the microcontroller 211 tests whether the locked rotor time is greater than a specified time period, such as 5 seconds. If the result of the test in Step 750 is no, then the control goes to Step 740. If the result of the test in Step 750 is yes, then in Step 760 DEF pump 110 is stopped for a specified time period, such as 5 seconds. Then the control proceeds to Step 770. In Step 770, microcontroller 211 tests whether the number of re-start cycles is greater than or equal to a specific number of cycles, such as 30. If the result of the test in Step 770 is no, then control goes to Step 710. If the result of the test in Step 770 is yes, then in Step 780 DEF pump 110 is shut down, and microcontroller 211 does not try to restart DEF pump 110. After DEF pump 110 is shut down in Step 780, the power must be cycled to restart DEF pump 110.

The disclosed embodiments are illustrative, not restrictive. While specific configurations have been described, it is understood that the present invention can be applied to a wide variety of DEF pump designs and used with a wide variety of diesel and diesel-electric engines. There are many alternative ways to implement the invention.

The invention claimed is:

1. A diesel exhaust fluid pump comprising:
a motor comprising:
a plurality of Type-H stator windings; and
a rotor;
a drive shaft;
a drive shaft bushing;
a pump body cover;
a pump body housing;
a pump body insert;
a plurality of gears;
an inlet for receiving a diesel exhaust fluid from a first tank;
an outlet for supplying the diesel exhaust fluid to a second tank;
a shaft seal for separating the motor from the diesel exhaust fluid;
an inverter assembly comprising:
a microcontroller;
a bus connector;
an inverter housing;
a cooling pipe integrated into the inverter housing;
wherein the microcontroller controls circulation of diesel exhaust fluid through the cooling pipe to pull heat away from the inverter assembly; and
wherein the microcontroller shuts down the diesel exhaust fluid pump when pressure at the outlet of the diesel exhaust fluid pump is below a minimum fluid level threshold.

2. The diesel exhaust fluid pump of claim 1, wherein the drive shaft bushing comprises polyetheretherketone (PEEK).

3. The diesel exhaust fluid pump of claim 1, wherein the drive shaft comprises 316 stainless steel.

4. The diesel exhaust fluid pump of claim 1 wherein the pump body insert comprises 316 stainless steel;
the plurality of gears comprises 30 percent carbon-filled polyetheretherketone (PEEK); and
the pump body cover comprises 316 stainless steel.

5. The diesel exhaust fluid pump of claim 1 further comprising:
a spring;
a shaft seal seat;
wherein the shaft seal further comprises:
a moving portion; and
a stationary portion;
wherein the spring is attached to the moving portion; and
wherein the stationary portion is pressed into the shaft seal seat.

6. The diesel exhaust fluid pump of claim 5 further comprising:
the stationary portion of the shaft seal comprising at least one material selected from the group consisting of 304 stainless steel, fluoroelastomer, ceramic, and silicon carbide; and
wherein the moving portion of the shaft seal comprises at least one material selected from the group consisting of 304 stainless steel, fluoroelastomer, ceramic, and silicon carbide.

7. The diesel exhaust fluid pump of claim 1 wherein the plurality of gears further comprises:
a drive gear; and
an idler gear.

8. The diesel exhaust fluid pump of claim 1, wherein a centerline of the diesel exhaust fluid pump is located above the first tank.

9. The diesel exhaust fluid pump of claim 1, wherein the diesel exhaust fluid pump further comprises:
a speed sensor for use in determining the diesel exhaust fluid pump has a locked rotor; and
a pressure sensor for use in determining the diesel exhaust fluid pump is running dry.

10. The diesel exhaust fluid pump of claim 9, wherein the speed sensor is waterproof, and wherein the pressure sensor is waterproof.

11. The diesel exhaust fluid pump of claim 1 further comprising:
at least one mounting foot for connecting the diesel exhaust fluid pump to a vehicle;
a heat exchanger comprising a plurality of fins; and
a plurality of drain holes.

* * * * *